US008424642B2

(12) United States Patent
Lietz

(10) Patent No.: US 8,424,642 B2
(45) Date of Patent: Apr. 23, 2013

(54) STABILIZER KIT FOR PROVIDING REINFORCING SUPPORT TO A LADDER

(76) Inventor: James D. Lietz, Emmett, MI (US)

( * ) Notice: Subject to any disclaimer, the term of this patent is extended or adjusted under 35 U.S.C. 154(b) by 150 days.

(21) Appl. No.: 12/844,264

(22) Filed: Jul. 27, 2010

(65) Prior Publication Data

US 2011/0017549 A1 Jan. 27, 2011

Related U.S. Application Data

(60) Provisional application No. 61/228,662, filed on Jul. 27, 2009.

(51) Int. Cl.
*E06C 7/10* (2006.01)

(52) U.S. Cl.
USPC ..... 182/172

(58) Field of Classification Search ..... 182/172, 182/201, 108, 109, 111; 248/351, 354.1, 248/354.4, 354.5, 354.6; 403/196, 235, 236, 403/256, 258–260
See application file for complete search history.

(56) References Cited

U.S. PATENT DOCUMENTS

| | | | | | |
|---|---|---|---|---|---|
| 1,735,992 | A | * | 11/1929 | Bode | 182/104 |
| 2,320,144 | A | * | 5/1943 | Johnson | 182/201 |
| 3,568,798 | A | | 3/1971 | Pierce | |
| 3,878,917 | A | * | 4/1975 | McBride | 182/172 |
| 3,901,354 | A | | 8/1975 | Grebausky | |
| 3,903,991 | A | | 9/1975 | Phelan | |
| 4,164,269 | A | | 8/1979 | Jackson | |
| 4,175,641 | A | | 11/1979 | Reyes | |
| 4,519,477 | A | | 5/1985 | Ralston | |
| 4,625,832 | A | | 12/1986 | Hartley | |
| 4,641,729 | A | | 2/1987 | Beck et al. | |
| 4,872,529 | A | | 10/1989 | Viets | |
| 4,899,849 | A | | 2/1990 | Levi et al. | |
| 4,964,488 | A | | 10/1990 | Stewart | |
| 5,141,076 | A | * | 8/1992 | Joyce et al. | 182/108 |
| 5,462,133 | A | | 10/1995 | Merrill, Jr. et al. | |
| 5,511,632 | A | | 4/1996 | Ermis | |
| 5,553,963 | A | * | 9/1996 | Hoy et al. | 403/164 |
| 5,669,462 | A | * | 9/1997 | Jennings | 182/111 |
| 5,868,222 | A | | 2/1999 | Charbonneau | |
| 5,915,498 | A | | 6/1999 | Figliuzzi | |
| 5,931,259 | A | | 8/1999 | Hoey | |
| 6,427,803 | B1 | | 8/2002 | Moore | |
| 6,527,084 | B2 | | 3/2003 | Hrincu | |
| 6,533,071 | B1 | | 3/2003 | Smith | |
| 6,672,427 | B1 | | 1/2004 | Sheffield | |
| 6,799,660 | B1 | * | 10/2004 | Crawford | 182/200 |
| 7,093,690 | B2 | | 8/2006 | Swann | |
| 7,163,084 | B1 | | 1/2007 | Blehm | |
| 7,216,742 | B2 | | 5/2007 | Spengler | |
| 7,293,630 | B1 | | 11/2007 | Trebec | |

* cited by examiner

*Primary Examiner* — Katherine Mitchell
*Assistant Examiner* — Kristine Florio
(74) *Attorney, Agent, or Firm* — Gifford, Krass, Sprinkle, Anderson & Citkowski, P.C.; Douglas J. McEvoy

(57) ABSTRACT

A stabilizer for use with a ladder including a first elongated portion terminating in a bracket securing to a frame location of the ladder and a second portion telescopically connected to the first portion and terminating in angled foot support. The bracket includes a first component pivotally secured to the first elongated portion and a second inter-engageable component secured to the ladder. The first elongated component exhibits a pair of outer spaced and extending portion between which extends the second portion. A pivotal handle is located at an interface between the first and second elongated portions and exhibits an engaging surface for releasably locking the first and second elongated portions together.

14 Claims, 9 Drawing Sheets

STABILIZER KIT FOR PROVIDING REINFORCING SUPPORT TO A LADDER

CROSS-REFERENCE TO RELATED APPLICATIONS

This Application claims the benefit of U.S. Provisional Application 61/228,662 filed on Jul. 27, 2009.

FIELD OF THE INVENTION

The present invention relates generally to bracing and reinforcing supports for use with an existing ladder. More specifically, the present invention discloses a stabilizer retrofit kit and assembly for use with either of standard folding and telescoping ladders and which provides an enhanced degree of lateral anti-rocking support to the ladder, such as further resulting in peace of mind to a user supported upon an elevated step location of the ladder.

BACKGROUND OF THE INVENTION

An issue with the use of existing "A" frame and telescoping ladders includes their relative and increasing levels of instability, particularly when mounted by a user at upper steps. Such safety concerns are amplified in instances where ladders are used by home construction and maintenance or repair individuals, such as whom require a stable elevated platform while engaged in various tasks which often require use of both hands in the handling of hammers, power tools, materials and the like.

SUMMARY OF THE INVENTION

The present invention is a stabilizer kit for use with existing "A" frame and telescoping ladders and which provides effective retrofit support for anchoring the ladder at a desired location, thereby reducing the incidence of falls resulting from ladder tip-over. The kit includes a telescoping and length adjustable body exhibiting, at a first end, a multi-axial and fixedly re-adjustable bracket suitable for engaging a side frame location of the ladder.

An opposite end of the kit further exhibits a pivotal foot support such that, and upon fixing the overall length of the body to a desired dimension and securing to an "A" frame ladder, the foot support is supported upon a floor location. The foot support can be biasingly supported against the floor location, as well as further nailed to the floor or fitted within an enlarged pad, in turn also capable of being affixed to the floor by nails or screws or exhibiting biasing and resistively engaging teeth on its underside to enhance frictional engagement.

In a further application applied to a telescopically extensible ladder, the angle of attachment of the bracket is readjusted so that the affixed body extends in a generally horizontal fashion. In this manner, the foot support can be affixed (such as again by nails or the like) to a proximate wall location and such as is particularly applicable in housing construction applications where bare studs are revealed in an intermediate construction phase and by which such affixation of the stabilizer can be accomplished without defacing. It is further envisioned that any plurality of stabilizers can be employed for engaging at least one of front and side locations associated with a ladder and according to the safety concerns of the user.

BRIEF DESCRIPTION OF THE DRAWINGS

Reference will now be made to the attached drawings, when read in combination with the following description, wherein like reference numerals refer to like parts throughout the several views, and in which.

DETAILED DESCRIPTION OF THE PREFERRED EMBODIMENTS

Referring now to the various illustrations the present invention discloses a stabilizer retrofit kit and assembly for use with a standard folding and/or elongated (including one piece and telescoping) ladders, and which provides an enhanced degree of lateral anti-rocking support to the ladder, such as further resulting in peace of mind to a user supported upon an elevated step location of the ladder. As will be described with reference to the various illustrations, the present invention discloses a stabilizer which can be secured to either an extending side location, as well as to either of forward and/or rear face locations associated with individual steps of the ladder.

It is further understood that the present invention contemplates the ability to install any number of stabilizers at various front, rear and side locations of the ladder and which, dependent upon the ground conditions associated with the application of the ladder, provide peace of mind to a user, as well as further dispensing with the need of additional individuals providing bracing support to a user supported at an elevated location upon an otherwise unsecured ladder.

Figure 1:
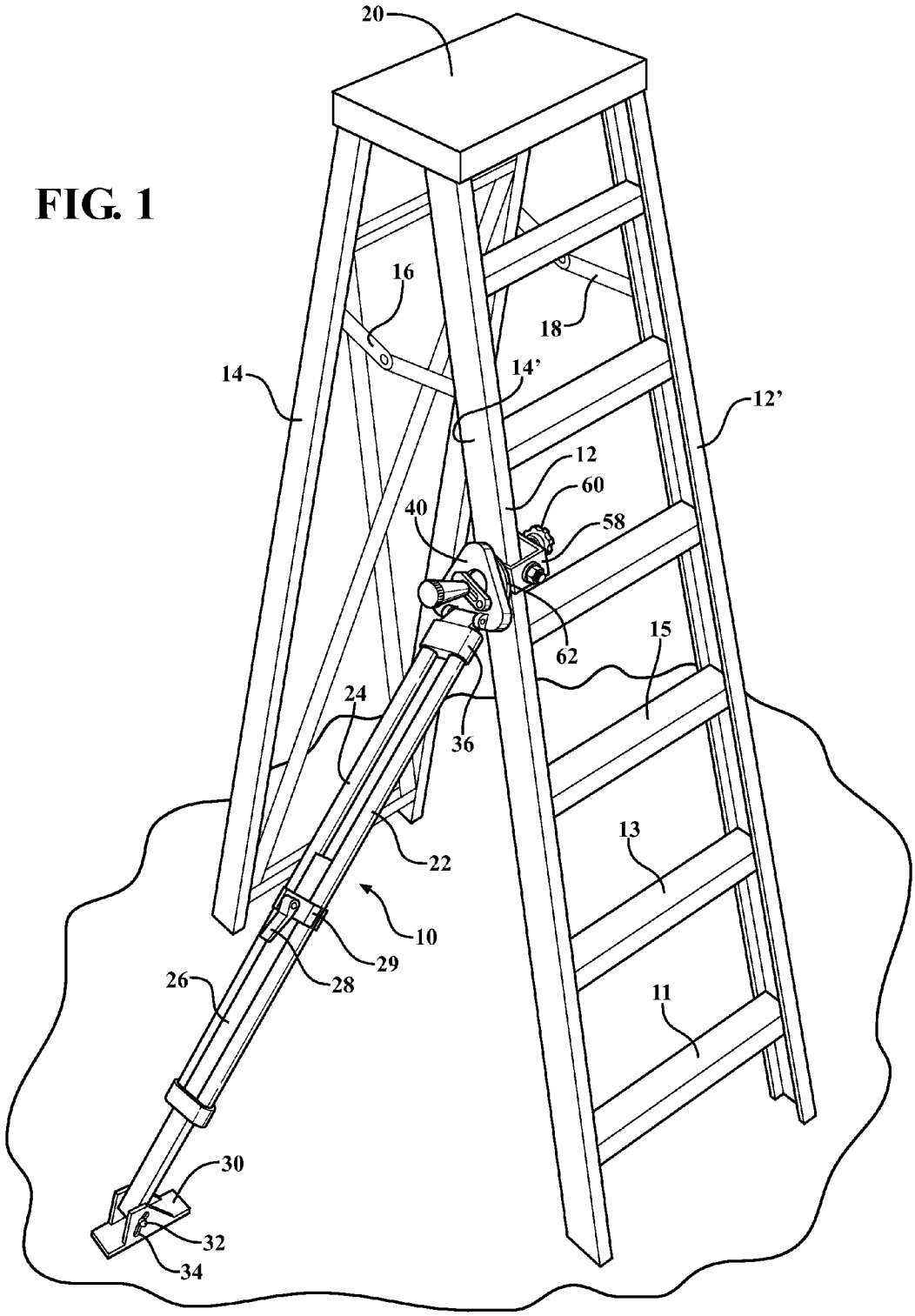
FIG. 1 is an environmental view in perspective of the stabilizer kit installed in lateral extending fashion to a standard foldable "A" frame ladder and which illustrates the features of an elongated telescoping body with a first end multi-axial bracket secured to a frame location of the ladder and a second end foot support resting upon a floor location.

Referring initially to FIG. 1, an environmental view is generally shown at 10 in perspective of a stabilizer installed in lateral extending fashion to a standard foldable "A" frame ladder, such as further depicted by angled and sub-frame defining sides 12 & 12' and 14 and 14', at least one of which includes a plurality of spaced apart steps 11, 13, 15, et seq., the sides 12 and 14 pivotally supported by brackets 16 and 18 and terminating in a top platform 20. As described, the stabilizer 10 is capable of being utilized with any type of ladder such as further including an elongated and leaning ladder (FIG. 7) and such as which further contemplates any type of telescoping ladder. The stabilizer illustrated herein is further considered to also form part of a kit, such as which can include the provision of additional stabilizers of identical configuration, as well as any number of enlarged pads for providing additional floor biasing support (see subsequent description of FIGS. 8-10).

The kit, as most broadly illustrated, includes a linearly adjustable and elongated body constructed of any of a wood, metal or high strength polymeric material and including an upper/outer or first elongated portion which is illustrated as a fixed pair of spaced apart portions 22 and 24 defining a channel therebetween). An inner and second telescoping portion 26 extends through the channel established between the outer and first pair of spaced apart portion 22 and 24 and, with the use of an intermediately positioned and pivotal locking handle 28 located in a fixed pivoting fashion (such as via brace 29) at an interface between the elongated telescoping portions and exhibiting any type of cam, chamfer, bevel or other suitable uneven and engaging surface. The construction of the pivotally mounted handle 28 is further such that, upon adjusting the upper/outer extending portions 22 and 24 relative to the inner telescoping portion 26, the handle 28 is rotated so that the uneven surface biases the telescoping members together in order to establish an overall length dimension of the stabilizer body. Although not shown, it is also envisioned that the length adjustable portions associated with the elongated body can also be provided as inner and outer telescoping portions as well as any other type of ratchet engaging and/or serrated engaging portions which provide for secure height readjustment.

The lower/inner adjustable portion 26 terminates in a floor gripping pedestal support or foot 30, this exhibiting a planar bottom and upwardly angled flanged sides which receive an extending end of the lower/inner portion 26 in pivotally engaged fashion (see pin 32 seated in pivotal fashion within a slot further defined by inner perimeter and arcuate/elongate surface 34 defined in each side flange portion). Such as pivotal floor support can exhibit frictional engaging properties (see again further enlarged pads in FIGS. 8-10) similar to that incorporated into the floor engaging locations of a typical ladder). In many applications, the foot support 30 in use provides the requisite gripping of a floor or ground location astride the floor engaging locations associated with the front and rear portions of the ladder.

Figure 2:
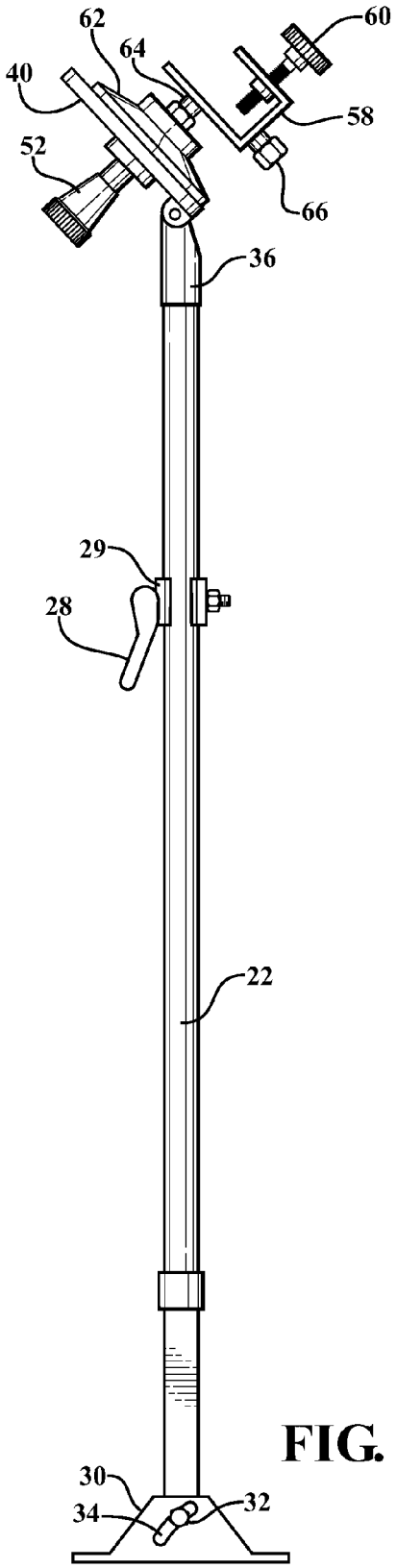
FIG. 2 is a side view of the stabilizer kit in FIG. 1 and depicting the bracket disengaged from the ladder.
Figure 3:
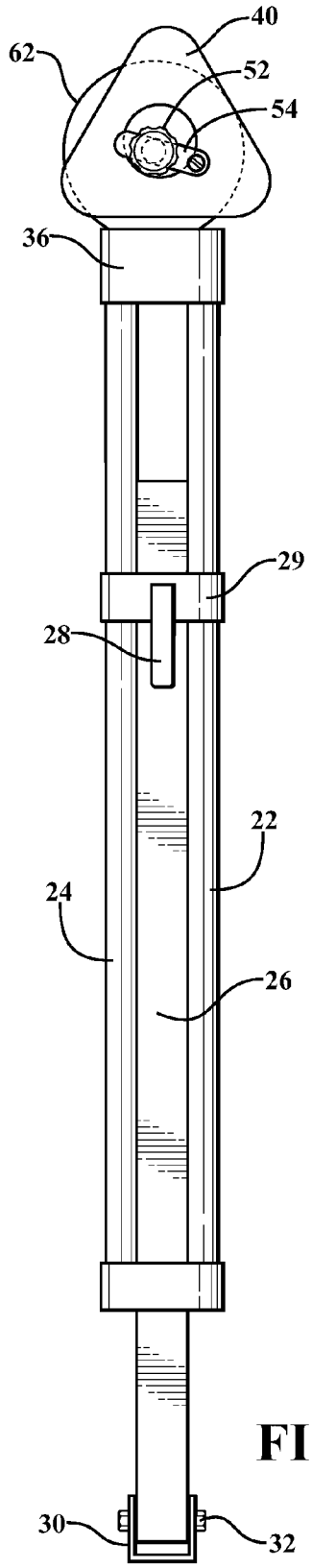
FIG. 3 is a rotated front view of the stabilizer shown in FIG. 2.
Figure 4:
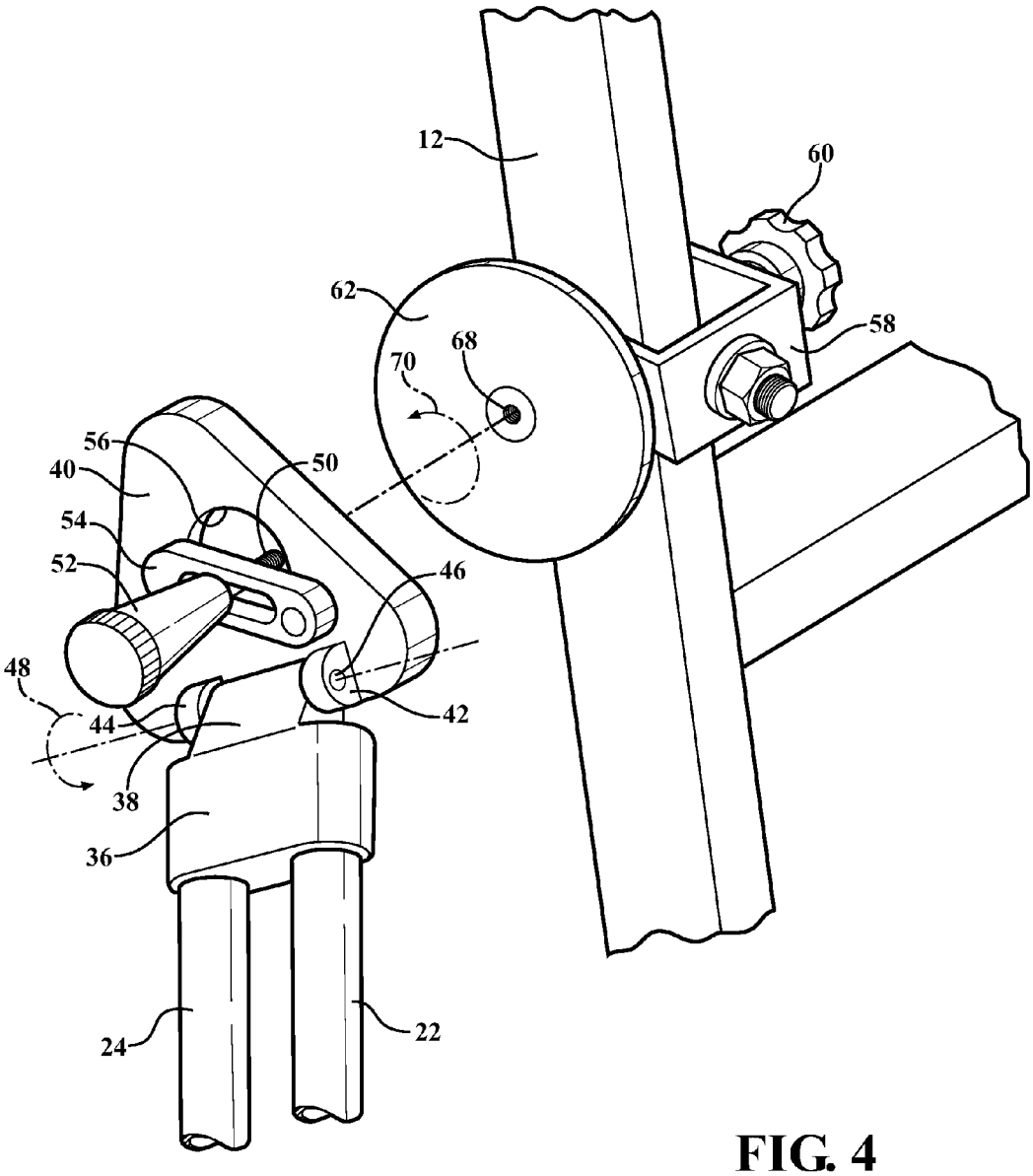
FIG. 4 is an enlarged and exploded sectional view of the bracket and illustrating a first component secured to the ladder frame and to which is in turn engaged a second multi-axial adjustable component.

As further depicted in FIGS. 2-4, a multi-axial repositionable bracket is provided in secured fashion to an end of the outer/upper telescoping portion (again portions 22 and 24). As best depicted in the enlarged view of FIG. 4, a collar 36 secures to aligned ends of the spaced apart portions 22 and 24 and in turn terminates in a first axis supporting portion 38. A generally planar (see as shown in triangular shape) member 40 includes spaced apart support tabs 42 and 44 extending proximate a rear edge location and which seats over ends of the supporting portion 38, such that aligning apertures in the tabs 42 and 44 and interposed supporting portion 38 permit the insertion of a pin 46 to thereby define a first base pivot (see directional arrow 48) and further such that the first planar member 40 defines a pivotally affixed component to the elongated body. A screw 50 projects from a turning knob 52 which is seated to a bridge component 54 extending over a central aperture (see inner perimeter surface 56) and so that the screw 50 projects through the planar supporting portion 40.

Figure 5:
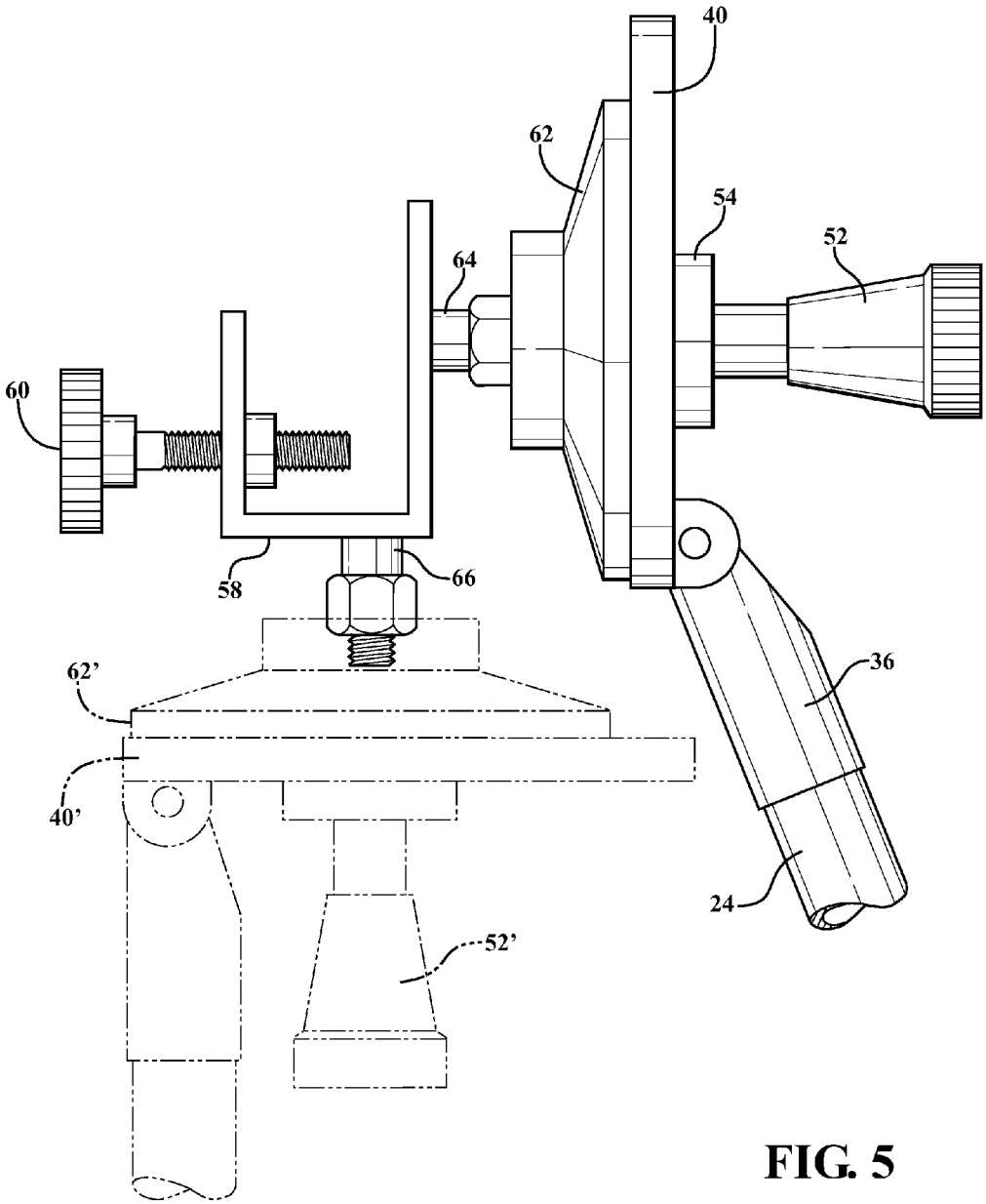
FIG. 5 is a partial view of a modified mounting configuration associated with the bracket and by which the second component is capable of mounting to either of first or second locations of the first component to adapt to differing support configurations.

A further and separable component associated with the bracket includes a generally "U" shaped bracket 58 mounted to a selected side frame location 12 of the ladder. A turn screw 60 is mounted in threadably displaceable fashion through a selected side of the bracket 58. A secondary planar shaped member (illustrated by circular or disc shaped component 62) is secured to either of a first 64 fastener secured to the U bracket 58 at a first installation position or, alternatively (as illustrated in phantom in FIG. 5) to a second 66 ninety degree offset bracket mounted fastener location.

The disc shaped component 62 exhibits a central threaded aperture 68 (see as best shown in FIG. 4) and, upon seating against the surface of the first triangular planar shaped component 40, is fastened by threaded engagement of the turning knob 52 and associated screw 50. Selective loosening and tightening of the screw permits the planar members 40 and 62 to be repositioned relative to one another at any desired angular offset (see further arrow 70 in FIG. 4), thereby providing the additional axis of angular adjustment.

The illustration of FIG. 5, as again indicated, includes a repetitive phantom designation of the overlapping components at a second installed location associated with second support 66, at 62' and 40', with further reference to alternatively positioned turning knob 52'. In this fashion, the subset component of the overall bracket including the stabilizer mounted and pivotal member 40 can be repositioned in a second axial fashion against further overlapping member 62 in turn secured at either of first 66 or second 68 fastener mount locations associated with the bracket 58. As will be further described, the significance of providing for multi-positional engagement between the individual bracket components assists in applying to either of floor and/or wall fixing locations so as to provide additional bracing support.

Figure 6:
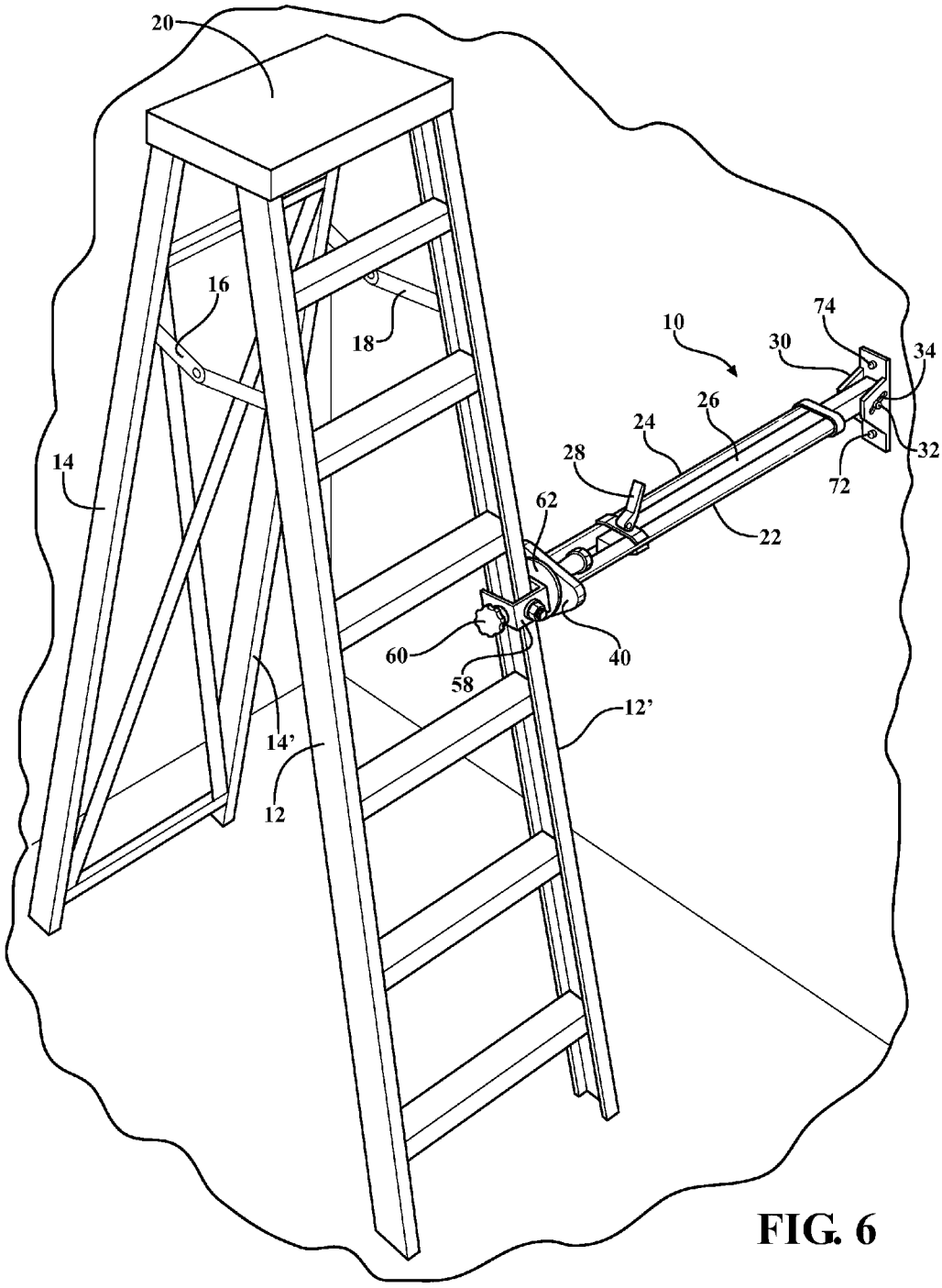
FIG. 6 is an environmental illustration of the "A" frame ladder of FIG. 1, and in which the stabilizer has been repositioned to be supported against a vertical wall location.

FIG. 6 is an environmental illustration of the "A" frame ladder as depicted in FIG. 1, and in which the stabilizer as generally shown at 10 has been repositioned to a further side frame extending location of the ladder, this also including the collar 36 being rotated so that the outer telescoping support portions 22 and 24 extend generally perpendicularly from the face of the pivotally secured planar support 40, and to be supported against a vertical wall location, this including the additional provision of a pair of screw fasteners 72 and 74 which are pierced through the angled foot 32, or aligned to pass through pre-formed apertures in the foot support. This configuration provides an enhanced degree of side brace reinforcement over and above a nominal floor bias supporting arrangement and is particularly useful in situations where a ladder is positioned proximate a wall location.

Figure 7:
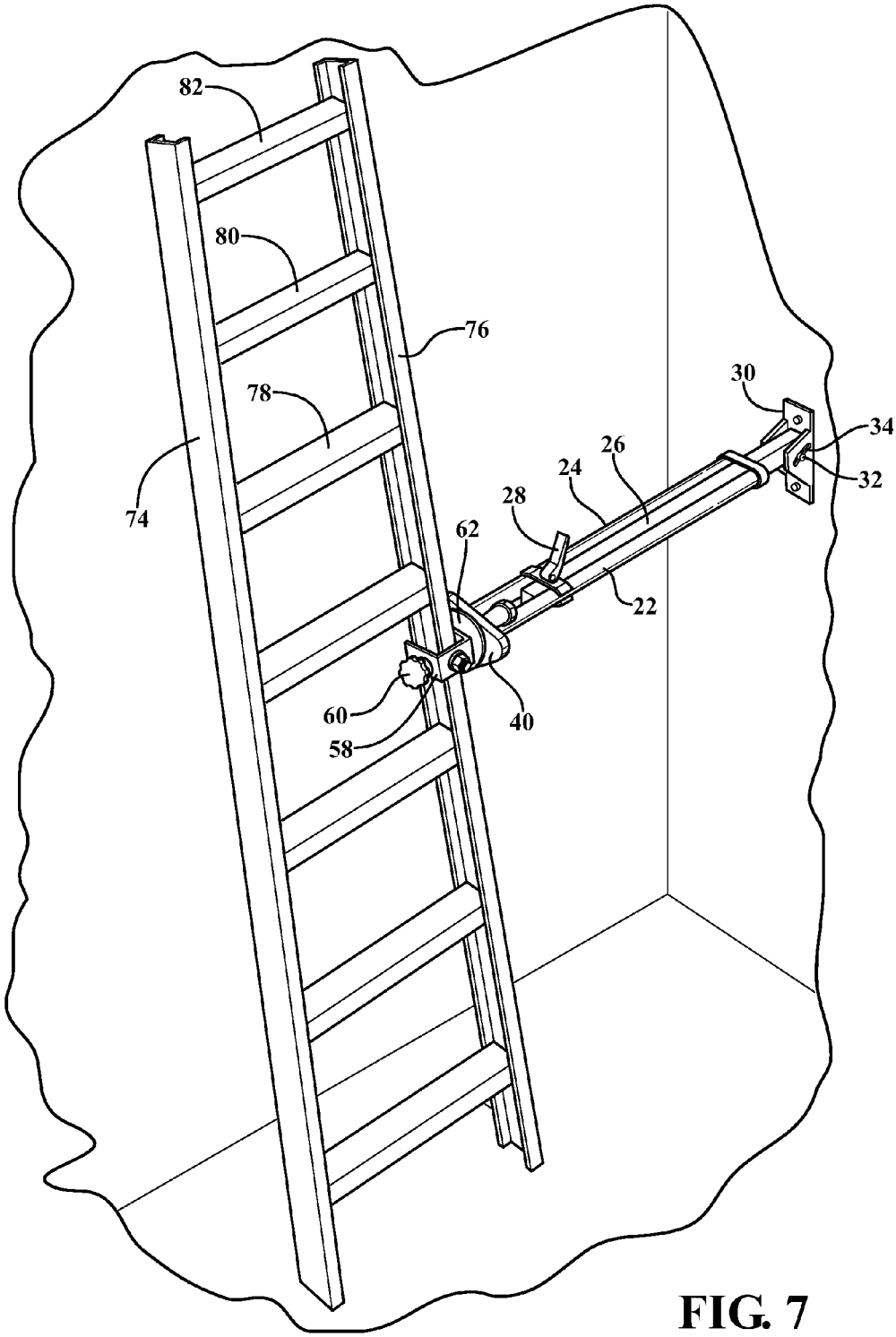
FIG. 7 is an identical application of the stabilizer to that depicted in FIG. 6, with the exception that the "A" frame ladder is substituted for an angled (such as telescoping) ladder.

FIG. 7 is an identical application of the stabilizer to that depicted in FIG. 6, with the exception that the "A" frame ladder is substituted for an angled (such as telescoping) ladder. The ladder in this variant, as known, includes a single side defined frame (or multiple telescoping frames) with side edges 74 and 76, between which extend succeeding steps 78, 80, 82, et seq.

Figure 8:
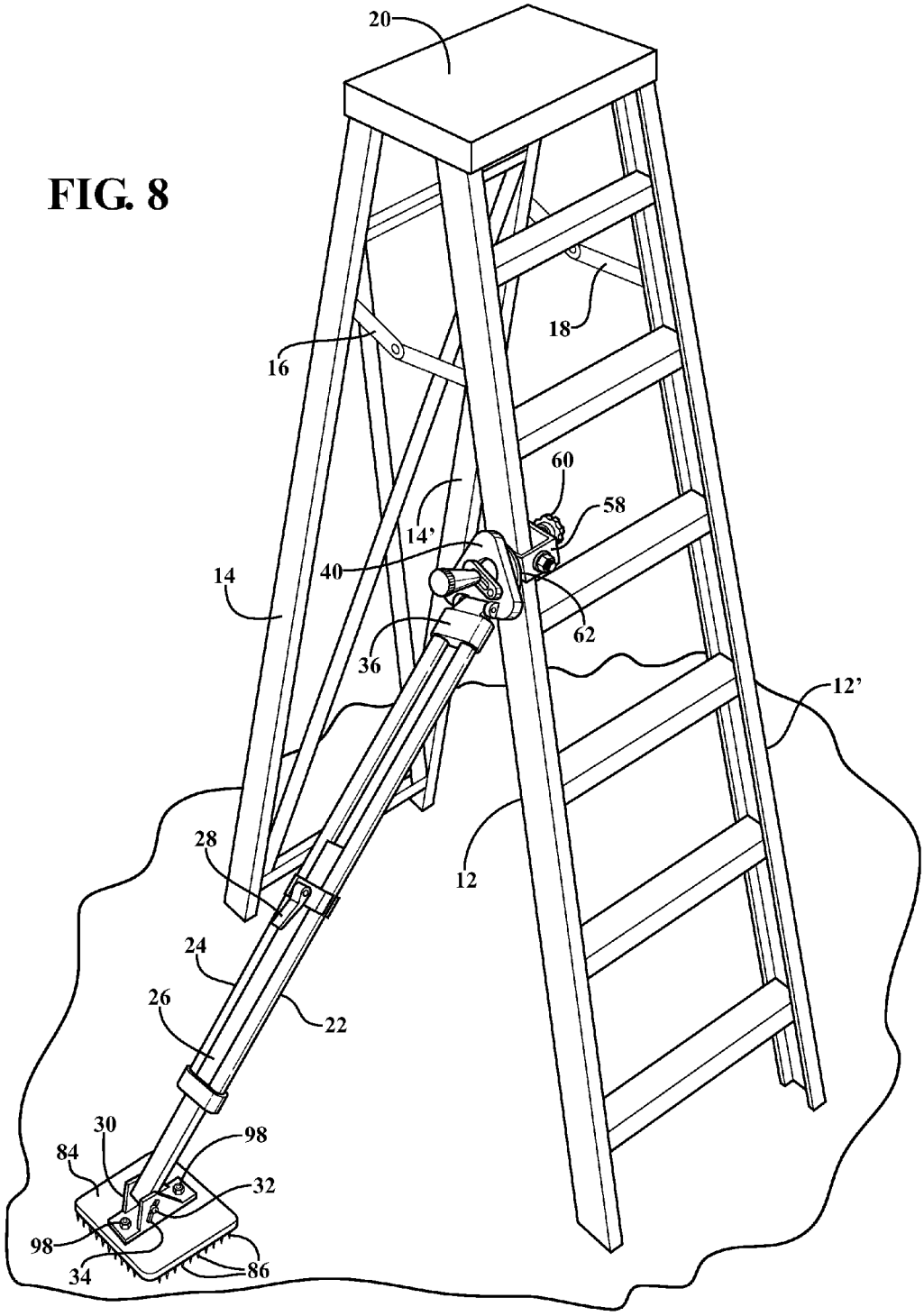
FIG. 8 is a further environmental depiction similar to FIG. 1 and in which an enlarged pad is depicted and which is secured to the stabilizer foot support to enhance its floor gripping aspects.

FIG. 8 is a further environmental depiction similar to FIG. 1 and in which an enlarged pad 84 is depicted and which is secured to the stabilizer foot 30 to enhance its floor gripping aspects. As further shown in the exploded partial view of FIG. 9, the enlarged pad 84 can be constructed of any suitable material which, in one application, is a polymeric/rubberized composition exhibiting a high degree of frictional contact and further depicting underside configured gripping portions 86. Apertures 88 and 90 defined through the pad 84 can also align with additional apertures 92 and 94 in the foot support 30, this permitting pairs of bolts 96 and fastener nuts 98 to secure the foot support 30 atop the resistive/gripping pad 84.

Figure 9:
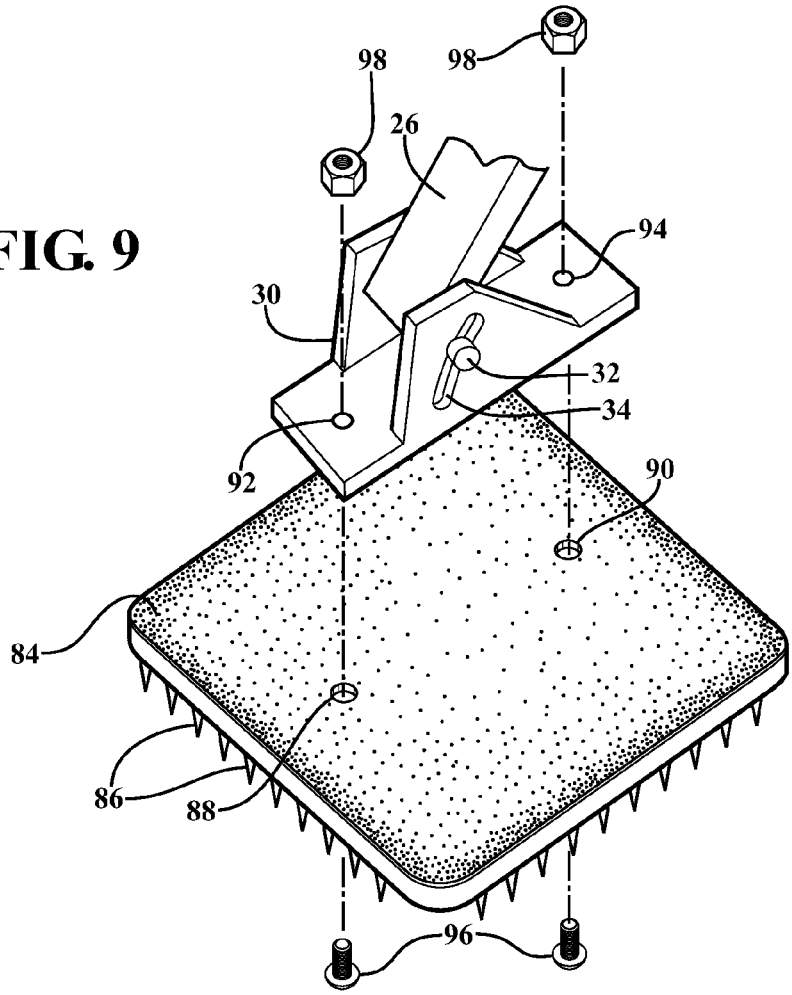
FIG. 9 is an exploded lower partial view of the angled foot support and enlarged pad and further depicting the underside configured gripping portions, as well as the ability to secure the pivotal foot support upon the pad via such as threaded bolts and nuts.
Figure 10:
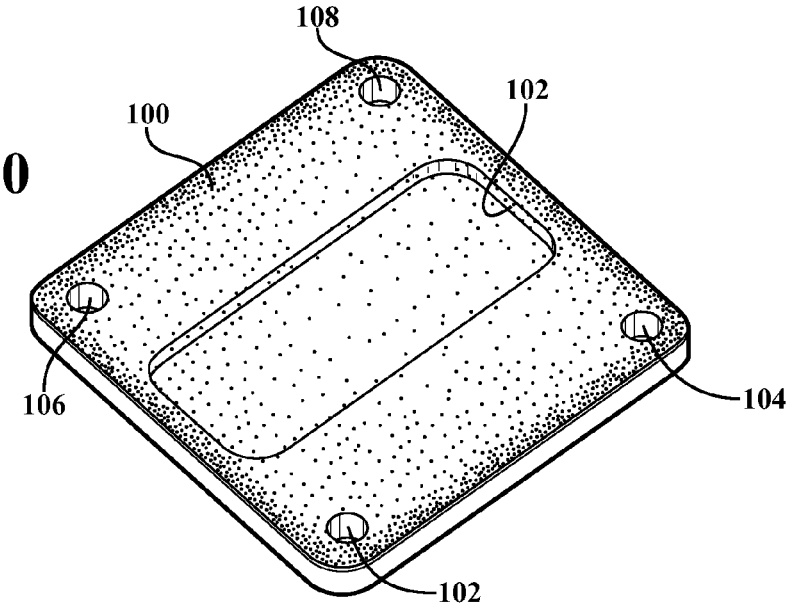
FIG. 10 is an illustration of an alternate configuration of enlarged support in comparison to that shown in FIGS. 8 and 9 and by which a central recess configuration defined within the pad is dimensioned to positionally seat therein the outline of the angled foot support, with the additional provision of outer fastener receiving apertures in substitution of the underside gripping portions for fixedly engaging the pad to a support location.

FIG. 10 is an illustration of an alternate configuration of enlarged support 100 in comparison to that shown in FIGS. 8 and 9 and by which a central recess configuration defined within the pad (see inner perimeter vertical wall 102) is dimensioned to positionally seat therein the outline of the angled foot support 30. Additionally provided are outer (fastener) receiving apertures 102, 104, 106 and 108 proximate respective corners of the pad 100, these in substitution of the underside gripping portions of FIG. 9, for fixedly engaging the pad to a support location.

Figure 11:
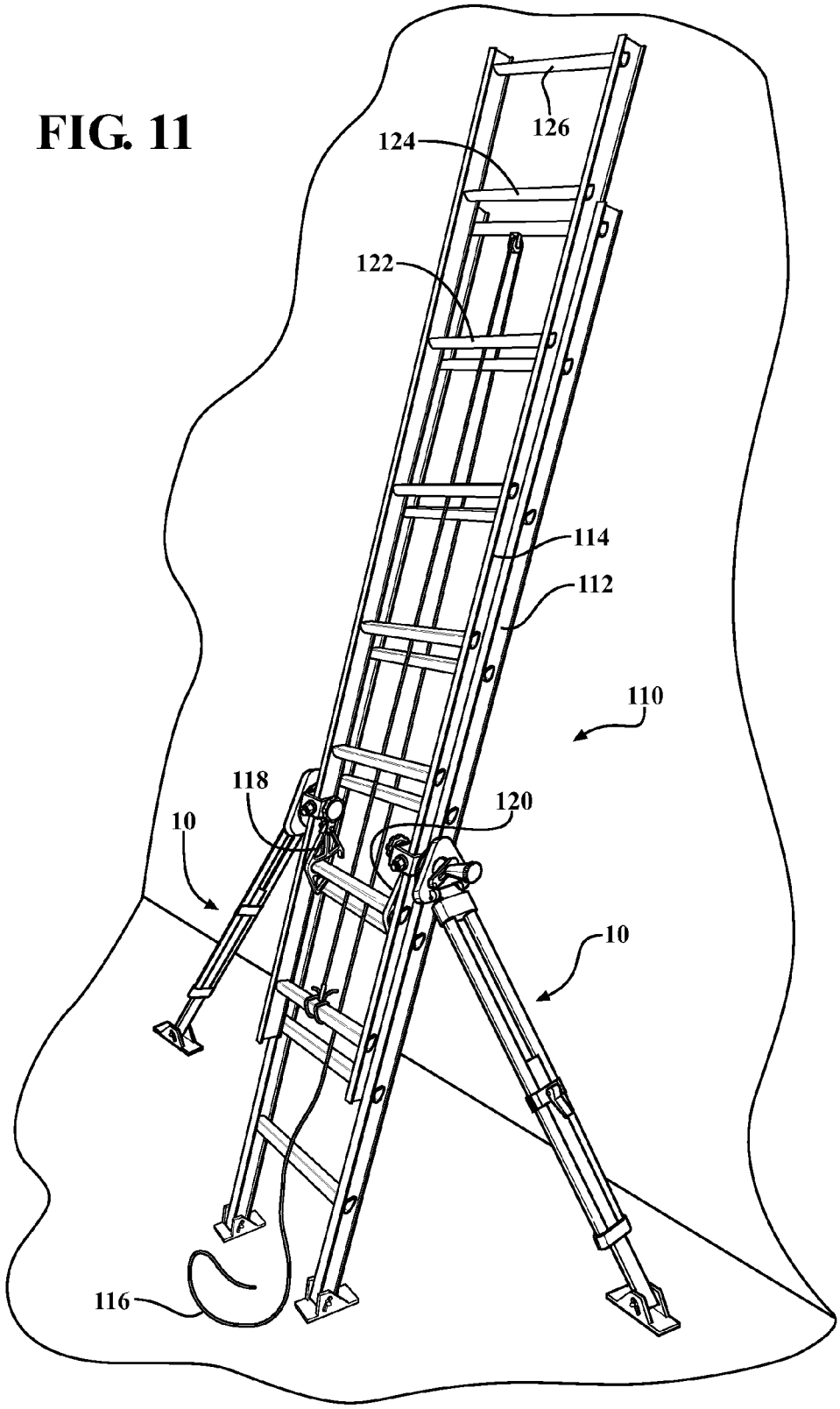
FIG. 11 is a further variant of a two piece telescoping ladder and which illustrates a pair of stabilizers arranged in angular extending fashion from opposite side frame locations.

Finally, FIG. 11 is a further variant generally illustrated at 110 of a two piece 112, 114 telescopically adjustable ladder (similar to the ladder variant illustrated in FIG. 7) and in which a pull rope 116 and ratchet arrangement (see side pivoting brackets 118 and 120) is employed for establishing a desired overall length. Further illustrated are a pair of identically constructed stabilizers (see further each at 10) which are arranged in angular extending fashion from opposite side frame locations of the ladder. As previously described, any plurality of stabilizers according to any of the constructions described can be secured extending fashion from the ladder and in order to provide enhanced stabilizing support, such as in particular when the user is supported upon uppermost steps or rungs (see further at 122, 124, 126) of the ladder.

Beyond the illustrated embodiments, the present invention also contemplates the installation of a stability inducing kit such as along a front facing surface associated with a horizontal step associated with either type of ladder. It is also envisioned that, in specified applications, multiple kits can be installed in opposite side and, additionally or alternatively, in front extending fashion such that the stability inducing kits can provide varying level of stability inducing support to a given application and such as to prevent the ladder from pivoting backwards or sideways in response to an uneven load resulting from a user supported at an elevated location (such as further in conditions where the foot supports are not otherwise anchored into a floor or wall location).

It is also again envisioned and understood that the stability kit can be used with any type of fixed or telescoping ladder, including such as those which do not include front and rear pivotally connected portions, but rather only include a single elongated extending and graduated stepped portion, such as which can further include a single section or multiple parallel extending and length adjustable sections which are both ground supported and leaned against an elevated location. It is also envisioned and understood that the stabilizer can additionally be incorporated into an originally manufactured design of a folding or extensible ladder, as well as being provided as a retrofit clamp engaged assembly.

Having described my invention, other and additional preferred embodiments will become apparent to those skilled in the art to which it pertains, and without deviating from the scope of the appended claims.

I claim:

1. A stabilizer kit for use with a ladder to provide retrofit support, said kit comprising:

at least one body having a pair of outer elongated portions supported at opposite ends in fixed and spaced apart fashion so as to define a channel therebetween;

an inner elongated portion extending through said channel established between said outer portions and capable of telescopically displacing in first and second directions over a defined range;

a pivotal locking handle supported upon said body at an intermediate location and exhibiting an underside engaging surface, said handle being rotated between a release position permitting telescoping displacement of said inner portion relative to said outer elongated portions and a locking position fixing said inner and outer portions at a desired overall extending length;

said outer elongated portions terminating at one end in a multi-axial adjustable bracket adapted to secure to a frame location of the ladder;

a collar secured to aligned ends of said outer elongated and spaced apart portions, said collar terminating in a first axis supporting portion, a first planar member including spaced apart support tabs which seats over ends of said supporting portion such that aligning apertures in the tabs and said interposed supporting portion permit the insertion of a pin to define a first base pivot and further such that said planar member defines a pivotally affixed component to said outer portions;

a screw projecting from a turning knob which is seated to a bridge component extending over a central aperture defined in said planar member and so that said screw projects through said supporting portion;

a further and separable component associated with said bracket including a generally "U" shaped ladder mounting bracket, a turn screw being mounted in threadably displaceable fashion through a selected side of said bracket, a secondary planar shaped member overlapping said first planar member secured to either of a first fastener secured to said U bracket at a first installation position or a second offset bracket mounted fastener;

said second planar member further comprising a disc shape exhibiting a central threaded aperture which, upon seating against the surface of said first planar shaped member, is fastened by threaded engagement of said turning knob and associated screw such that selective loosening and tightening of said screw permits said planar members to be repositioned relative to one another at any desired angular offset in second axial adjustment;

said inner telescopically adjustable portion terminating, at an end opposite said bracket, in a pivotal foot support exhibiting frictional engaging properties such that said body is configured in a floor supporting position; and at least one fastener inserting through said foot support such that said body may be reconfigured for engaging a vertical location in a wall supporting position.

2. The invention as described in claim 1, further comprising an enlarged pad secured to said foot support.

3. The invention as described in claim 2, said pad exhibiting polymeric/rubberized composition exhibiting a high degree of frictional contact and further depicting underside configured gripping portions.

4. The invention as described in claim 2, further comprising apertures defined through said pad which align with additional apertures in said foot support permitting pairs of bolts and fastener nuts to secure said foot support to said pad.

5. The invention as described in claim 2, said pad further comprising a central recess configuration defined therein which is dimensioned to positionally seat an outline of said foot support.

6. The invention as described in claim 2, said pad further comprising receiving apertures defined therethrough for fixedly engaging said pad to a support location.

7. The invention as described in claim 1, further comprising first and second stabilizers adapted to being secured to opposite side frame locations of a telescoping ladder.

8. A stabilizer kit for use with a ladder to provide retrofit support, said kit comprising:

at least one elongated body having at least one outer portion and an inner telescopically supported portion displaceable relative to said outer portion in first and second directions over a defined range;

a pivotal locking handle supported upon said body at an intermediate location and exhibiting an underside engaging surface, said handle being rotated between a release position permitting telescoping displacement of said inner portion relative to said outer portion and a locking position fixing said inner and outer portion at a desired overall extending length within said defined range;

said at least one outer elongated portion terminating at one end in a multi-axial adjustable bracket adapted to secure to a frame location of the ladder, said bracket having a collar secured to aligned ends of said at least one outer elongated portion, said collar terminating in a first axis supporting portion, a first planar member including spaced apart support tabs which seats over ends of said supporting portion such that aligning apertures in the tabs and said interposed supporting portion permit the insertion of a pin to define a first base pivot and further such that said planar member defines a pivotally affixed component to said outer portion;

a screw projecting from a turning knob which is seated to a bridge component extending over a central aperture defined in said planar member and so that said screw projects through said supporting portion;

a further and separable component associated with said bracket including a generally "U" shaped ladder mounting bracket, a turn screw being mounted in threadably displaceable fashion through a selected side of said bracket, a secondary planar shaped member overlapping said first planar member secured to either of a first fastener secured to said U bracket at a first installation position or a second offset bracket mounted fastener;

said second planar member further comprising a disc shape exhibiting a central threaded aperture which, upon seating against the surface of said first planar shaped member, is fastened by threaded engagement of said turning knob and associated screw such that selective loosening and tightening of said screw permits said planar members to be repositioned relative to one another at any desired angular offset in second axial adjustment;

said inner telescopically adjustable portion terminating, at an end opposite said bracket, in a pivotal foot support exhibiting frictional engaging properties such that said body is configured in a floor supporting position; and at least one fastener inserting through said foot support such that said body may be reconfigured for engaging a vertical location in a wall supporting position.

9. The invention as described in claim 8, further comprising an enlarged pad secured to said foot support.

10. The invention as described in claim 9, said pad exhibiting polymeric/rubberized composition exhibiting a high degree of frictional contact and further depicting underside configured gripping portions.

11. The invention as described in claim 9, further comprising apertures defined through said pad which align with additional apertures in said foot support permitting pairs of bolts and fastener nuts to secure said foot support to said pad.

12. The invention as described in claim 9, said pad further comprising a central recess configuration defined therein which is dimensioned to positionally seat an outline of said foot support.

13. The invention as described in claim 9, said pad further comprising receiving apertures defined therethrough for fixedly engaging said pad to a support location.

14. The invention as described in claim 8, further comprising first and second stabilizers adapted to being secured to opposite side frame locations of a telescoping ladder.

* * * * *